US010766511B2

(12) United States Patent
Schalk

(10) Patent No.: US 10,766,511 B2
(45) Date of Patent: Sep. 8, 2020

(54) CABLE DRIVEN RAILROAD SWITCH INDICATOR

(71) Applicant: David A. Schalk, Festus, MO (US)

(72) Inventor: David A. Schalk, Festus, MO (US)

( * ) Notice: Subject to any disclaimer, the term of this patent is extended or adjusted under 35 U.S.C. 154(b) by 320 days.

(21) Appl. No.: 15/918,015

(22) Filed: Mar. 12, 2018

(65) Prior Publication Data

US 2018/0201283 A1 Jul. 19, 2018

Related U.S. Application Data

(63) Continuation of application No. PCT/US2016/051183, filed on Sep. 10, 2016.

(60) Provisional application No. 62/216,518, filed on Sep. 10, 2015.

(51) Int. Cl.

| | |
|---|---|
| ***B61L 5/12*** | (2006.01) |
| ***B61L 9/02*** | (2006.01) |
| ***B61L 9/00*** | (2006.01) |
| ***B61L 5/10*** | (2006.01) |
| *B61L 9/04* | (2006.01) |

(52) U.S. Cl.

CPC ..... *B61L 5/12* (2013.01); *B61L 5/10* (2013.01); *B61L 9/00* (2013.01); *B61L 9/02* (2013.01); *B61L 9/04* (2013.01)

(58) Field of Classification Search

CPC ..... B61L 5/10; B61L 5/12; B61L 9/00; B61L 9/02; B61L 9/04

USPC ..... 246/476

See application file for complete search history.

(56) References Cited

U.S. PATENT DOCUMENTS

| | | | | | |
|---|---|---|---|---|---|
| 469,130 | A * | 2/1892 | Erwin | B61L 5/14 | 246/14 |
| 480,825 | A * | 8/1892 | Nye | B61L 9/00 | 246/476 |
| 1,027,468 | A * | 5/1912 | Fisher et al. | B61L 5/02 | 246/285 |
| 1,056,706 | A * | 3/1913 | Melick | B61L 11/02 | 246/343 |
| 1,158,482 | A * | 11/1915 | Gorrell | B61L 9/02 | 246/476 |
| 1,557,626 | A * | 10/1925 | Swanson | B61L 9/00 | 246/409 |
| 1,557,698 | A * | 10/1925 | Hull | B61L 9/00 | 246/476 |

(Continued)

FOREIGN PATENT DOCUMENTS

| | | | | |
|---|---|---|---|---|
| FR | 2876648 A1 * | 4/2006 | B61L 5/10 | |
| GB | 515031 A | 11/1939 | | |

OTHER PUBLICATIONS

International Search Report and Written opinion in co-pending international application No. PCT/US2016/051183.

*Primary Examiner* — Zachary L Kuhfuss
(74) *Attorney, Agent, or Firm* — Grace J. Fishel

(57) ABSTRACT

A railroad switch indicator, that operates independently of the mechanism for operating the switch, for signaling the position of the switchpoints via a flexible mechanical cable connected to a railroad switch amplifier mechanism. The railroad switch amplifier mechanism has linkage members attached to a crossbar connecting inner stockrails and to a pivoted lever arm, the output arm of which is attached to the mechanical cable. The flexible mechanical cable allows the railroad switch indicator to be positioned remotely from the switchpoints and switch amplifier mechanism in a highly visible and easily serviced location.

10 Claims, 5 Drawing Sheets

(56) References Cited

U.S. PATENT DOCUMENTS

| | | | | | |
|---|---|---|---|---|---|
| 1,756,601 | A * | 4/1930 | McElhaney | B61L 9/00 | 246/476 |
| 2,278,213 | A * | 3/1942 | Quenon | B61L 9/00 | 246/476 |
| 2,740,041 | A * | 3/1956 | Marcum | B61L 9/00 | 246/220 |
| 4,337,914 | A * | 7/1982 | Rich | B61L 5/02 | 246/393 |
| 5,117,765 | A * | 6/1992 | Wahl | G08B 5/006 | 116/63 P |
| 5,806,809 | A * | 9/1998 | Danner | B61L 5/107 | 246/220 |
| 7,735,784 | B2 * | 6/2010 | Schalk | B61L 9/02 | 246/476 |
| 8,695,928 | B1 | 4/2014 | Schalk | | |
| 2008/0302921 | A1 * | 12/2008 | Schalk | B61L 5/10 | 246/476 |
| 2017/0291619 | A1 * | 10/2017 | King | B61L 7/06 | |

* cited by examiner

CABLE DRIVEN RAILROAD SWITCH INDICATOR

BACKGROUND OF THE INVENTION

Field of the Invention

The present invention relates to a cable operated railroad switch indicator with a plurality of visual indicators which are selectively visible for signaling the position of a pair of railroad switchpoints independently of the mechanism for operating the switch so as to indicate safety conditions on a railroad track.

Brief Description of the Prior Art

The present switch indicator is a variation on the switch indicator described and claimed in U.S. Pat. No. 8,695,928 for Railroad Switch Indicator with Distance Amplifier, which is incorporated by reference herein.

In order to optionally switch a railroad train operating on one track to a second track, it is typical to provide a switch with a pair of switchpoints which are selectively movable horizontally to deflect the train toward one or the other of the tracks. The switchpoints may be driven by a manual, hydraulic or electrical powered mechanism. A signal is usually associated with the mechanism for operating the switch to visually indicate how the switch is lined. If a train runs through the switch or if the switchpoints are moved by vibrations of a train rolling over the track, the switchpoints may be moved into a mid position which is not reflected by the signal associated with the mechanism for operating the switch.

When a train runs through a switch, a flange on the wheels picks open the switchpoints. Depending on how sharp the wheels are, the distance that the switchpoints move may be much less than an inch and yet a misalignment of as little as 0.25 inch may result in a disastrous derailment. Manual mechanisms commonly miss such a small movement and even sophisticated electrically powered switch mechanisms with sensors for open and closed switchpoints may give a false signal.

BRIEF SUMMARY OF THE INVENTION

In view of the above, it would be desirable to have a railroad switch indicator that operates independently of the mechanism for operating the switch, for signaling the position of the switchpoints and that is mechanically linked via a flexible mechanical cable to a railroad switch distance amplifier mechanism. The flexible cable allows the railroad switch indicator to be positioned remotely from the railroad switch distance amplifier mechanism so that the railroad switch indicator can be placed in a highly visible and easily serviceable location such as off to the side and/or in an elevated position relative to the railroad track.

Another object of the invention is to provide a railroad switch indicator that signals movements of the switchpoints that may be missed by the mechanism for operating the switch and that defaults to a safe position signaling caution. It is also an object to provide a railroad switch indicator that does not depend on electricity and can be used with mechanically operated switches as well as electrically powered switches. Other objects and features of the invention will be in part apparent and in part pointed out hereinafter.

In accordance with the invention, a railroad switch indicator for use with a switch for switching a railroad train is provided. The switch includes a pair of outer stockrails and a pair of inner switchrails with the inner switchrails having first ends secured to a track bed and second ends terminating with switchpoints. The inner stocktails are connected by a traverse bar for conjoint lateral movement of the switchpoints between switching and therefore diverging and non-switching and therefore non-diverging positions.

The multicolored reflective railroad signal illustrated in the drawings visually signals the position of a pair of railroad switchpoints independently of the mechanism for operating the switch. In this preferred embodiment, the signal is octagonal in shape so as to provide a plurality of reflectors that are easily visible from virtually any horizontal angle and therefore 360 degrees around the signal. Although it should be noted that the signal could be other shapes such as a circle, square, etc., have reflectors viewable also from the top or bottom or not have reflective surfaces viewable from 360 degrees around the switch indicator without deviating from the intent of the invention.

In the preferred embodiment the signal has a plurality of upper green reflectors located along the top perimeter of the signal and also a plurality of red reflectors located along the bottom perimeter of the signal. Although the signal could use reflectors having colors other than red and green without deviating from the intent of the invention. The signal could also incorporate powered LED's so as to improve the visibility of the signal. The signal could also have a translucent cover or no cover at all to let in ambient light to enhance the light output of translucent reflectors and therefore help to increase their visibility without deviating from the intent of the invention.

In the preferred embodiment the signal also has a vertically movable reflector blocking shield that is also octagonal in shape which can be moved up and down to selectively cover or uncover all or a portion of the upper green or lower red reflectors. This reflector blocking shield is movably driven by the flexible mechanical cable which is connected to and driven by the railroad switch distance amplification mechanism in the manner described below. Similar to the signal's shape, the vertically movable reflector blocking shield could be other shapes without deviating from the intent of the invention.

In use, when the switchpoints are in a nonswitching and therefore non-diverging position, the reflector blocking shield is lowered all the way and the upper green reflectors are visible. When the switchpoints are in the switching and therefore diverging position, the reflector blocking shield is raised all the way and the lower red reflectors are visible. Alternatively when the switchpoints are in a midpoint position, the reflector blocking shield automatically and without depending on electricity, defaults to a middle position thereby exposing a portion of both the upper red and lower green reflectors so as to indicate a dangerous, midpoint railroad switch position.

BRIEF DESCRIPTION OF THE SEVERAL VIEWS OF THE DRAWING

In the accompanying drawings, in which one of various possible embodiments of the invention is illustrated, in which.

DETAILED DESCRIPTION OF THE INVENTION

Figure 1:
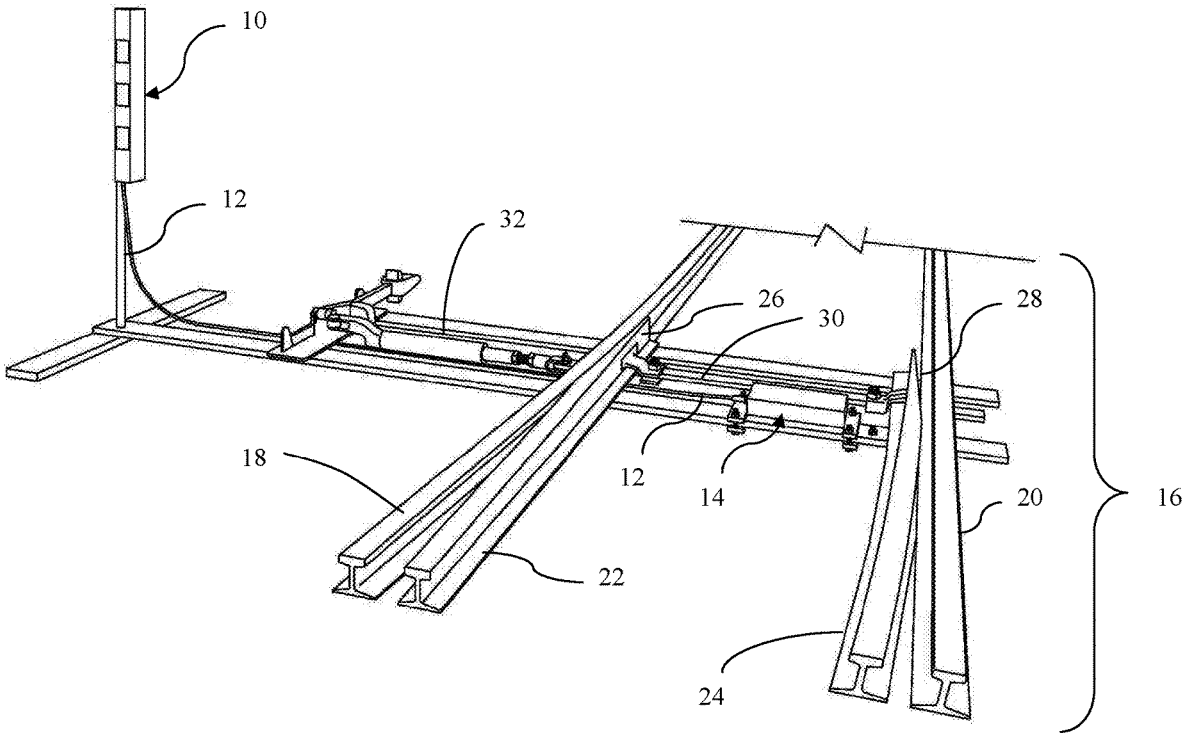
FIG. 1 is a perspective view of the cable driven railroad switch indicator system.

Referring to the drawings more particularly by reference character and beginning with FIG. 1, reference numeral 10 refers to a railroad switch indicator for use with a railroad switch 16 for switching a railroad train from one track to another.

Railroad switch 16 normally comprises a pair of fixed outer stockrails 18, 20 and pair of inner switchrails 22, 24. Inner switchrails 22, 24 have one end rigidly secured to the track bed and the opposite end terminating in laterally spaced switchpoints 26, 28 arranged for conjoint lateral movement between laterally spaced switching and non-switching positions. A transverse bar 30 connects inner rails 22, 24 for moving switchpoints 26, 28 conjointly from one position to another. Transverse bar 30 may be manually operated, hydraulically or electrically powered by a conventional mechanism 32.

As shown in FIG. 1, switchpoints 26, 28 are in nonswitching position with switchpoint 26 positioned against stationary left stockrail 18 and switchpoint 28 moved away from stationary right stockrail 20. In nonswitching position, switchpoint 26 will direct a train entering switch 16 straight through the intersection via right stockrail 20 and switchrail 22 which tapers outward into a straight left rail past switch 16. In a reverse position (not shown), both switchpoints are moved to the right with switchpoint 26 thus moved away from left stockrail 18 and switchpoint 28 moved to a position against right stockrail 20. Switchpoint 28 is thus in a position to direct the train to the left via left stockrail 18 which curves to the left past switch 16, and via right switchrail 28 which tapers outward to a curved right track past switch 16.

With continuing reference to FIG. 1, switch 16 is lined against a train curving to the left. If a train runs through switch 16 from the curved section, switchpoints 26, 28 will be pushed into a mid position such that they contact neither left nor right stockrails 18, 20 and a train coming through switch 16 from bottom to top may derail if the operator depends on the signals associated with mechanism 32 for moving switch points 26, 28 if they falsely indicate that switch 16 remains lined for straight through travel.

FIG. 1 also shows a vertically elongated version of a signal 10 that has a plurality of reflectors of alternating colors so as to give the operator an indication of the condition of the track or the switch. This vertically elongated version of a railroad switch indicator is described and claimed in U.S. Pat. No. 8,695,925 and subsequent drawings show another signal 11; the basic colored signaling scheme between the elongated version 10 and the octagonal 11 version remain the same.

With continued reference to FIG. 1 the elongated version signal 10 or octagonal signal 11 is motivated to vary its colored signals by a flexible mechanical cable 12 that transmits a mechanical push-pull force by movement of an flexible inner cable 42 relative to a stationary hollow outer cable housing 44. This flexible cable allows the signal 10 or 11 to be positioned remotely from the railroad switch distance amplifier mechanism 14 so that the signal can be placed in a highly visible and easily serviceable location such as off to the side and/or in an elevated position relative to the railroad track.

Figure 2:
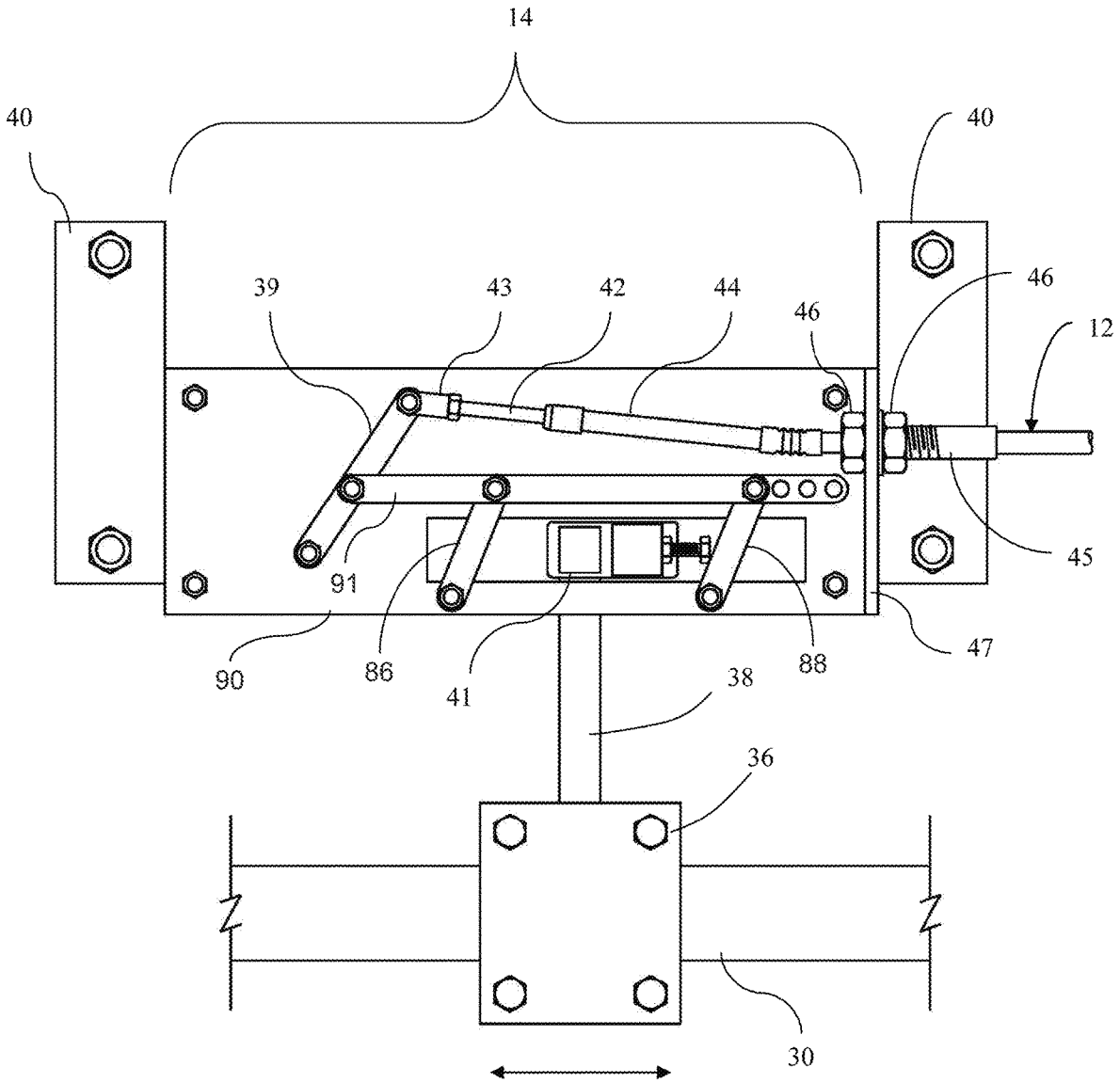
FIG. 2 is a plan view of a railroad switch distance amplifier mechanism along with a flexible mechanical cable.

As shown in FIG. 2, a railroad switch distance amplification mechanism is fixably mounted to the railroad track inside of outer stockrails 18, 20 using bolted mounting brackets 40. An operator is attached to inner stockrails 22, 24. As illustrated the operator includes a longitudinally extending arm 38 with an upwardly extending finger 41 attached via a bracket 36 to a transverse bar 30 connecting inner stockrails 22, 24. The finger 41 engages first and second spaced apart linkage arms 86, 88 pivoted to a frame 90 and to a cross member 91. The cross member 91 is adapted to apply a force between a pivoted end and an output end of a lever 39. The finger 41 contact a first of linkage arms 86, 88 when the switchpoints 26, 28 are in nonswitching position and contacts a second of linkage arms 86, 88 when the switchpoints are in switching position. When the switchpoints 26, 28 are in mid position, finger 41 contacts neither of the linkage arms 86, 88. With continuing reference to FIG. 2, the output end of lever 39 is attached to a clevis 43 which is attached to and therefore moves flexible inner cable 42 in relation to hollow cable outer housing 44 which is attached to fixed anchor point 47 on the frame 90. Flexible mechanical cable 12 incorporates a provision for adjusting the cable tension and the end point relationship between hollow cable outer housing 44 relative to flexible inner cable 42 using an inline hollow bolt 45 passing though fixed anchor point 47 and therefore lengthens or shortens the hollow cable outer housing 44 relative to flexible inner cable 42. The hollow bolt 45 is held in the desired position using locking nuts 42. When finger 41 engages linkage arms 86, 88, lever 39 moves a distance greater than the distance moved by switchpoints 26, 28, pulling or pushing cable 12 by that amplified amount, thus increasing the sensitivity of the railroad switch indicator to movement of the switchpoints.

Figure 3:
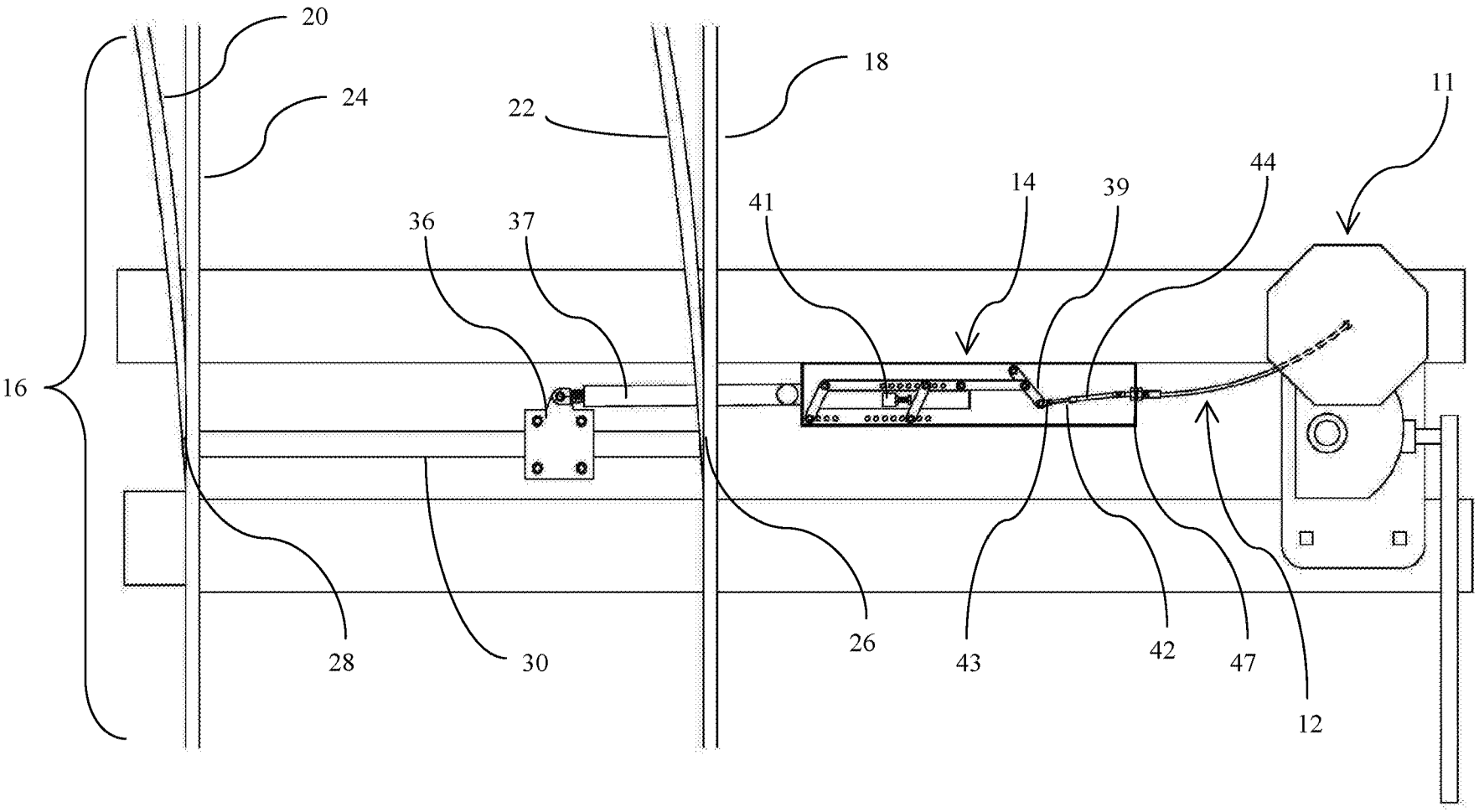
FIG. 3 is a plan view of the cable driven railroad switch indicator system.

FIG. 3 is a plan view of an alternate embodiment of the cable driven railroad switch indicator system in which the railroad switch distance amplifier mechanism 14 is placed alongside of the railroad track as opposed to in between the tracks as shown in FIG. 1 and FIG. 2. As shown in FIG. 1 it shows railroad switch 16 for switching a railroad train from one track to another.

Similarly to FIG. 1, railroad switch 16 comprises a pair of fixed outer stockrails 18, 20 and pair of inner switchrails 22, 24. Inner switchrails 22, 24 have one end rigidly secured to the track bed and the opposite end terminating in laterally spaced switchpoints 26, 28 arranged for conjoint lateral movement between laterally spaced switching and non-switching positions. A transverse bar 30 connects inner rails 22, 24 for moving switchpoints 26, 28 conjointly from one position to another. Transverse bar 30 may be manually operated, hydraulically or electrically powered by a conventional mechanism 32 not shown in this view.

In this alternative embodiment, transverse bar 30 is attached to and moves a transverse extending arm 37 via bracket 36. Similar to the previous switch indicator, a transverse extending arm 37 also has an upwardly extending finger 41. The finger 41 engages linkage arms 86, 88 that comprise the railroad switch distance amplification mechanism 14. When the finger 41 moves with the switchpoints, the amplification mechanism 14 moves the output lever arm 39 a distance greater than the distance moved by the finger 41 thereby increasing the sensitivity of the railroad switch indicator 11 to movement of the switchpoints 26 and 28. The output end of is output lever arm 39 is attached to clevis 43 which is attached to and therefore moves flexible inner cable 42 in relation to hollow cable outer housing 44 which is stationarily attached to fixed anchor point 47.

With continued reference to FIG. 3 the octagonal version of the railroad switch indicator 11 is motivated to vary its colored signals by a flexible mechanical cable 12 that transmits a mechanical push-pull force by the movement of an flexible inner cable 42 relative to a stationary hollow outer cable housing 44. This flexible cable allows the railroad switch indicator 11 to be positioned remotely from the railroad switch distance amplifier mechanism 14 so that the railroad switch indicator 11 can be placed in a highly visible and easily serviceable location such as off to the side and/or in an elevated position relative to the railroad track.

Figure 4:
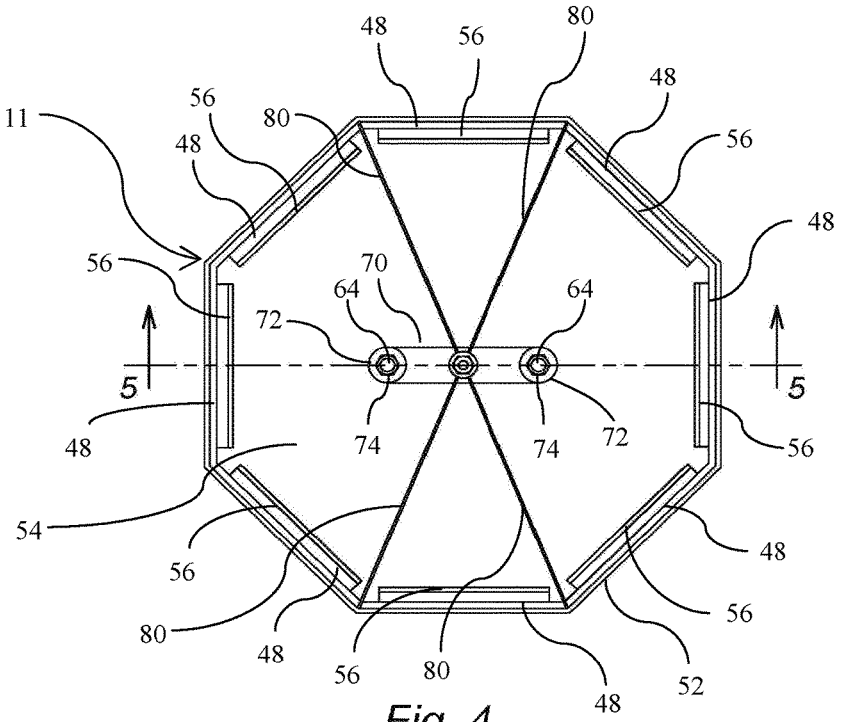
FIG. 4 is a top view of a signal with the top cover removed for clarity.
Figure 5:
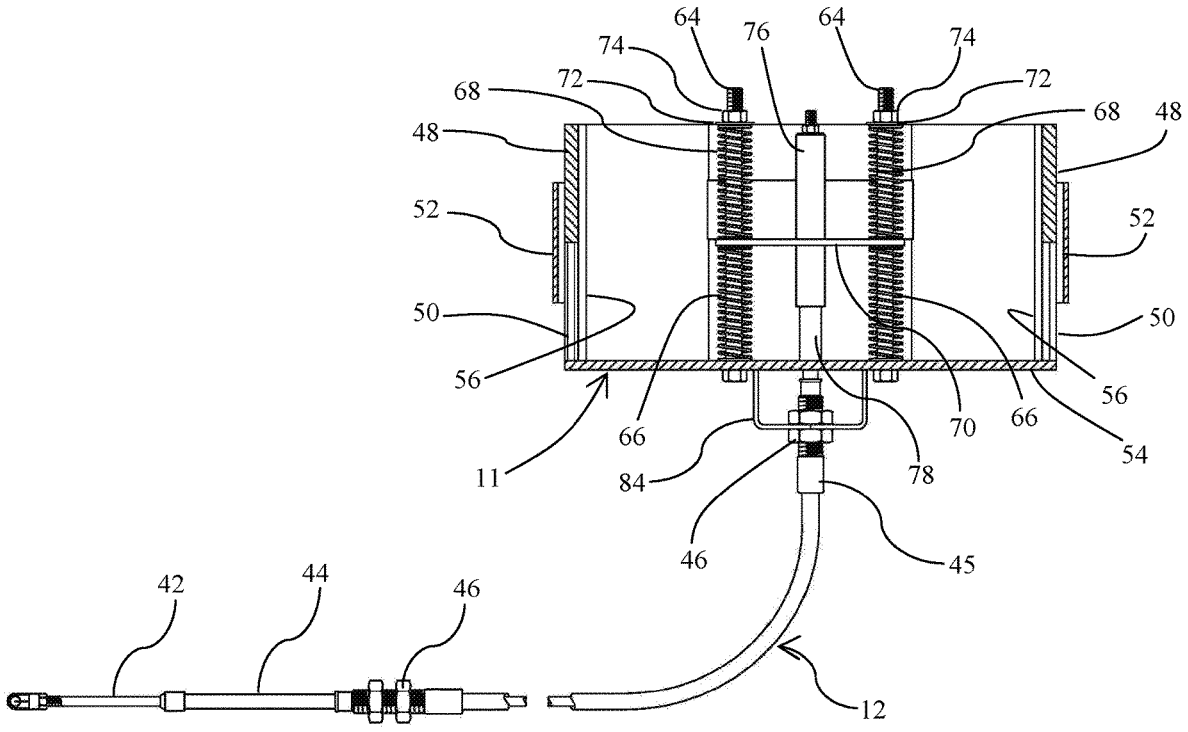
FIG. 5 is a detail view taken along the line 5-5 in FIG. 4
Figures 6A, 6B, 6C:
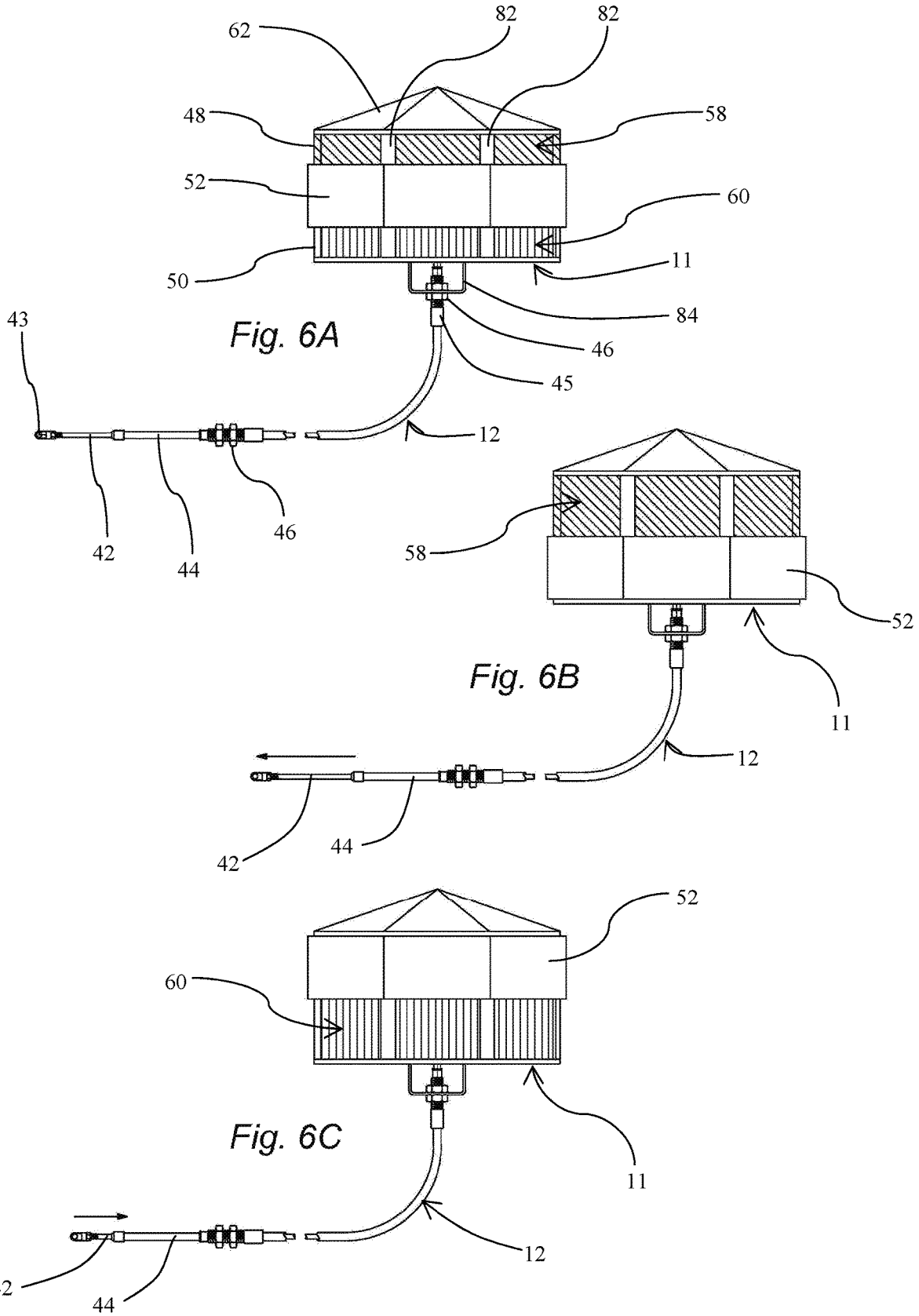
FIG. 6A is a side elevation view of the signal and flexible mechanical cable showing the reflector blocking shield in a midpoint position.
FIG. 6B is a side elevation view of the signal and flexible mechanical cable showing the reflector blocking shield in a lowered position.
FIG. 6C is a side elevation view of the signal and flexible mechanical cable showing the reflector blocking shield in a raised position.

FIG. 4 is a top view of the octagonal signal 11 with the top cover 62 which is shown in FIGS. 6A, 6B and 6C removed for clarity. FIG. 5 is a detail view taken along the line 5-5 in FIG. 4.

Referring to both FIG. 4 and FIG. 5; the signal is comprised of a octagonal shaped base plate 54 that has eight vertical flanges 56 rising upwards from it. Attached to each flange 56 is an upper green reflector 48 and lower red reflector 50. Therefore the eight octagonally arranged vertical flanges 56 with reflectors 48 and 50, when viewed from the side such as in FIGS. 6A, 6B and 6C, serve to form an upper ring of green reflectors 58 and a lower ring of red reflectors 60 as shown in FIGS. 6A, 6B and 6C.

With continuing reference to FIG. 5, the base plate 54 has two vertical spring bolts 64 rising upwards from it. Placed over each spring bolt 64 is a lower compression spring 66 and an upper compression spring 68. The upper compression springs 68 are retained on the spring bolts 64 using washers 72 and hex nuts 74. Sandwiched in between each lower spring 66 and upper spring 68 is a reflector shield base plate 70. When the lower compression springs 66 and upper compression springs 68 are of equal size and strength they serve to position the reflector shield base plate 70 in a middle position relative to the base plate 54 and washers 72. The reflector shield base plate is attached to outer tube 76 which is slidably mounted over inner tube 78. Attached to outer tube 76 are four reflector shield cross plates 80 that protrude through the gaps 82 in the vertical flanges 56 as shown in FIG. 6A. These reflector shield cross plates 80 are attached to a vertically movable octagonal shaped reflector blocking shield 52 that with up and down movement serves to selectively block all or portions of the upper ring of green reflectors 58 and/or the lower ring of red reflectors 60. As per the above, because the lower compression springs 66 and upper compression springs 68 are of equal size and strength they serve to position the reflector shield base plate 70 and therefore the reflector blocking shield 52 in a middle position relative to the upper ring of green reflectors 58 and a lower ring of red reflectors 60 when no other forces are applied.

In reference to FIG. 5 the other end of flexible mechanical cable 12 not attached to railroad switch distance amplifier mechanism 14 is attached to the signal base plate 54 via its fixed anchor point 84 Like the other end of the cable, this end of the mechanical cable 12 incorporates a provision for adjusting the cable tension and the end point relationship between flexible inner cable 42 and hollow cable outer housing 44 using an inline hollow bolt 45 which passes through fixed anchor point 84 and therefore lengthens or shortens the hollow cable outer housing 44 relative to flexible inner cable 42. Similar to the other end of the cable the hollow bolt 45 is then held in the desired position using locking nuts 46. This end of the flexible inner cable 42 is attached to outer shaft tube 76. Therefore when the inner cable 42 is pushed or pulled by railroad switch distance amplifier mechanism 14 it causes the vertically movable octagonal shaped reflector blocking shield 52 to move up or down so as to selectively block all or portions of the upper ring of green reflectors 58 and/or the lower ring of red reflectors 60.

In reference to FIG. 6A, shown is a side elevation view of the signal 11 and flexible mechanical cable 12 showing the reflector blocking shield 52 in a midpoint position therefore showing portions of both the upper ring of green reflectors 58 and the lower ring of red reflectors 60. Per the above this mid position is achieved when the railroad switch distance amplifier mechanism 14 neither pushes nor pulls on inner cable 42 due to the equalized spring pressure on both sides of the reflector shield base plate 70. In this way the signal 11 defaults to its mid position so as to indicate a dangerous, midpoint railroad switch position.

In reference to FIG. 6B, shown is a side elevation view of the signal 11 and flexible mechanical cable 12 showing the reflector blocking shield 52 in a lowered position and therefore showing only the upper ring of green reflectors 58. Per the above this lowered position is achieved when the railroad switch distance amplifier mechanism 14 pulls on inner cable 42. In this way the signal 11 indicates that the railroad switch 16 (not shown) is in a nonswitching position and therefore will direct a train entering switch 16 straight through the switchpoint.

In reference to FIG. 6C, shown is a side elevation view of the signal 11 and flexible mechanical cable 12 showing the reflector blocking shield in a raised position and therefore showing only the lower ring of red reflectors 60. Per the above this raised position is achieved when the railroad switch distance amplifier mechanism 14 pushes on inner cable 42. In this way the signal 11 indicates that the railroad switch 16 (not shown) is in a diverging switching position and therefore will direct a train entering switch 16 to turn to a track other than straight when going through the switchpoint.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A railroad switch indicator for switchpoints between outer and inner stockrails that operates independently of the mechanism for operating the switch comprising a signal having first and second visual indicators and an indicator shield that is spring biased in neutral position such that a portion of the first and second indicators are visible;

a switchpoint distance amplifier having an operator connected to the inner stockrails and a linkage including first and second spaced apart linkage arms pivoted to a frame and to a cross member, said cross member adapted to apply a force between a pivoted end and an output end of a lever arm, said operator contacting the first linkage arm when the switchpoints are in switching position and the second linkage arm when the switchpoints are in nonswitching position, said operator contacting neither the first linkage arm nor the linkage second arm in neutral position when the switchpoint are in a mid position; and, a push and pull cable attached to the output end of the lever arm and to the indicator shield, said cable pushed by the lever arm when rotated in a first direction and pulled by the lever arm when rotated in a second opposite direction, said cable moving the indicator shield over the first visual indicator when the operator pushes on one of said first and second spaced apart linkage arms rotating the lever arm in the first direction signaling that the switchpoints are in switching position and said cable moving the indicator shield over the second visual indicator when the operator pushes on the other of said first and second spaced apart linkage arms rotating the lever arm in the second opposite direction signaling that the switchpoints are in nonswitching position, said linkage defaulting to neutral position by action of the spring biased indicator shield through the cable when the switchpoints are in mid position and the operator is contacting neither the first linkage arm nor the second linkage arm.

2. The railroad switch indictor of claim 1 wherein the switchpoint distance amplifier is mounted between the outer stockrails and the operator includes a finger mounted on a longitudinally extending arm attached to a bracket on a transverse bar connecting the inner stockrails.

3. The railroad switch indicator of claim 1 wherein the switchpoint distance amplifier is mounted outside the outer stockrails and the operator includes a finger mounted on a horizontally extending arm attached to a bracket on a transverse bar connecting the inner stockrails.

4. The railroad switch indicator of claim 1 wherein the first visual indicators are red reflectors or lights and the second visual indicators are green reflectors or lights, said red reflectors or lights and green reflectors or lights mounted vertically one above the other and the indicator shield is a band eclipsing the red reflectors or lights when the switchpoints are in nonswitching position and eclipsing the green reflectors or lights when the switchpoints are in switching position.

5. A railroad switch indicator for switchpoints between outer and inner stockrails that operates independently of the mechanism for operating the switch comprising a signal having a base plate and upstanding spaced apart flanges upon which green and red reflectors are mounted to form an upper green ring and a lower red ring, a pair of spaced apart bolts upstanding on the base plate outfitted with upper and lower compression springs, said compression springs being substantially equal in strength, a reflector shield base plate sandwiched between the compression springs and mounted on upper and lower telescoping pipe sections upstanding between the bolts, cross plates attached to one of the pipe sections and passed through the spaces between the flanges, a reflector shield mounted on the cross plates outside of the flanges, said reflector shield vertically movable and covering the upper green ring when the switchpoints are in switching position, covering the red ring when the switchpoints are in nonswitching position and covering a portion of both the green ring and red ring when the switchpoints are in a mid position;

a switchpoint distance amplifier having an operator connected to the inner stockrails and a linkage including first and second spaced apart linkage arms pivoted to a frame and to a cross member, said cross member adapted to apply a force between a pivoted end and an output end of a lever arm, said operator contacting the first linkage arm when the switchpoints are in switching position and the second linkage arm when the switchpoints are in nonswitching position, said operator contacting neither the first linkage arm nor the linkage second arm in neutral position when the switchpoint are in a mid position; and, a push and pull cable attached to the output end of the lever arm and to the reflector shield base plate, said cable pushed by the lever arm when rotated in a first direction and pulled by the lever arm when rotated in a second opposite direction, said cable moving the indicator shield over the first visual indicator when the operator pushes on one of said first and second spaced apart linkage arms rotating the lever arm in the first direction signaling that the switchpoints are in switching position and said cable moving the indicator shield over the second visual indicator when the operator pushes on the other of said first and second spaced apart linkage arms rotating the lever arm in the second opposite direction signaling that the switchpoints are in nonswitching position, said linkage defaulting to neutral position by action of the spring biased indicator shield through the cable when the switchpoints are in mid position and the operator is contacting neither the first linkage arm nor the second linkage arm.

6. The railroad switch indictor of claim 5 wherein the switchpoint distance amplifier is mounted between the outer stockrails and the operator includes a finger mounted on a longitudinally extending arm attached to a bracket on a transverse bar connecting the inner stockrails.

7. The railroad switch indicator of claim 5 wherein the switchpoint distance amplifier is mounted outside the outer stockrails and the operator includes a finger mounted on a horizontally extending arm attached to a bracket on a transverse bar connecting the inner stockrails.

8. The railroad switch indicator of claim 5 wherein the signal base plate is octagonal and there are eight flanges.

9. The railroad switch indicator of claim 8 wherein the push and pull cable has a flexible movable inner cable and a stationary hollow outer housing.

10. The railroad switch indicator of claim 9 wherein a means for adjusting the inner cable tension is provided on the signal base plate and on the frame supporting the switchpoints distance amplifier linkage.

* * * * *